US006684855B2

(12) United States Patent
Murakami et al.

(10) Patent No.: US 6,684,855 B2
(45) **Date of Patent: *Feb. 3, 2004**

(54) COMMON RAIL FUEL INJECTION APPARATUS AND CONTROL METHOD THEREOF

(75) Inventors: Motoichi Murakami, Gotenba (JP); Yoshimasa Watanabe, Sunto-gun (JP); Kazuhiro Omae, Atsugi (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/098,394

(22) Filed: Mar. 18, 2002

(65) Prior Publication Data

US 2002/0134353 A1 Sep. 26, 2002

(30) Foreign Application Priority Data

Mar. 23, 2001 (JP) ..... 2001-085605

(51) Int. Cl.[7] ..... F02M 37/04
(52) U.S. Cl. ..... 123/446; 123/496
(58) Field of Search ..... 123/446, 496, 123/500, 501, 504, 506; 417/397, 403, 534

(56) References Cited

U.S. PATENT DOCUMENTS

| | | | | | |
|---|---|---|---|---|---|
| 4,448,168 | A | | 5/1984 | Komada et al. | 123/446 |
| 4,459,959 | A | * | 7/1984 | Terada et al. | 123/446 |
| 4,798,186 | A | * | 1/1989 | Ganser | 123/467 |
| 5,622,152 | A | | 4/1997 | Ishida | 123/446 |
| 5,711,277 | A | * | 1/1998 | Fuseya | 123/496 |
| 5,713,520 | A | | 2/1998 | Glassey et al. | 239/92 |
| 5,842,452 | A | * | 12/1998 | Pattanaik | 123/467 |
| 5,894,992 | A | | 4/1999 | Liu et al. | 239/91 |
| 6,092,509 | A | * | 7/2000 | Tanabe et al. | 123/447 |
| 6,293,252 | B1 | | 9/2001 | Niethammer et al. | 123/447 |
| 6,328,017 | B1 | * | 12/2001 | Heinz et al. | 123/467 |
| 6,345,605 | B1 | * | 2/2002 | Augustin et al. | 123/446 |

FOREIGN PATENT DOCUMENTS

| | | | |
|---|---|---|---|
| DE | 4118237 | A | 12/1991 |
| DE | 19916657 | A | 10/2000 |
| EP | 0691471 | A | 1/1996 |
| JP | U-59-152173 | | 10/1984 |
| JP | U-64-8569 | | 1/1989 |
| JP | 01159458 | A | 6/1989 |
| JP | 10238432 | A | 9/1998 |
| JP | 2882209 | B2 | 2/1999 |
| JP | 2885076 | B2 | 2/1999 |
| JP | 2000-130293 | A | 5/2000 |
| RU | 2078244 | C | 4/1997 |

* cited by examiner

*Primary Examiner*—Carl S. Miller
(74) *Attorney, Agent, or Firm*—Oliff & Berridge, PLC

(57) ABSTRACT

A common rail fuel injection apparatus includes a piston that increases the injection pressure, and a chamber that controls the position of the piston so as to control the injection pressure. An input constriction that sets an amount of flow of the fuel that enters the control chamber, and an output constriction that sets an amount of flow of the fuel that exits from the chamber are formed. The input constriction is connected to a common rail by a valve. By opening and closing the valve, the injection pressure of the fuel injected from an injector is changed. Therefore, the injection pressure of fuel injected from the injector can be changed as requested without a need to process high precision component parts.

19 Claims, 14 Drawing Sheets

COMMON RAIL FUEL INJECTION APPARATUS AND CONTROL METHOD THEREOF

INCORPORATION BY REFERENCE

The disclosure of Japanese Patent Application No. 2001-085605 filed on Mar. 23, 2001 including the specification, drawings and abstract is incorporated herein by reference in its entirety.

BACKGROUND OF THE INVENTION

1. Field of Invention

The invention relates to a common rail fuel injection apparatus and a control method thereof.

2. Description of Related Art

Common rail fuel injection apparatus capable of changing the injection pressure of fuel injected from an injector are known. An example of such common rail fuel injection apparatus is described in Japanese Patent No. 2885076. In the common rail fuel injection apparatus described in Japanese Patent No. 2885076, the injection pressure of fuel injected from an injector is changed by disconnecting/connecting a pressure reduction passage extending between the injector and a return passage through the use of a pressure-increasing piston. More specifically, when the lift of the pressure-increasing piston is less than a predetermined amount, the pressure reduction passage extending between the injector and the return passage is not disconnected by the pressure-increasing piston, but the fuel pressure in the injector is reduced by injection. Conversely, when the lift of the pressure-increasing piston is greater than the predetermined amount, the pressure reduction passage extending between the injector and the return passage is disconnected by the pressure-increasing piston, so that the fuel pressure in the injector is increased.

However, in the common rail fuel injection apparatus described in Japanese Patent No. 2885076, whether the fuel pressure in the injector is to be increased or not is greatly dependent on the relative position of the pressure-increasing piston with respect to the pressure reduction passage. If, for example, the load of a spring that urges the pressure-increasing piston is different from a designed value, there is a possibility that the pressure reduction passage will not be disconnected by the pressure-increasing piston when the pressure reduction passage needs to be disconnected by the pressure increasing piston. There is another possibility that the pressure reduction passage will be disconnected by the pressure-increasing piston when the pressure reduction passage should not be disconnected by the pressure increasing piston. Similar possibilities arise if, for example, the position of the pressure reduction passage is different from the designed position. That is, in the common rail fuel injection apparatus described in Japanese Patent No. 2885076, if factors and the like that determine the relative position of the pressure-increasing piston with respect to the pressure reduction passage are different from the designed factors and the like, there is a possibility that the fuel pressure in the injector is increased when the fuel pressure in the injector should be reduced, or a possibility that the fuel pressure in the injector is reduced when the fuel pressure in the injector should be increased.

SUMMARY OF THE INVENTION

Accordingly, it is one aspect of this invention to provide a common rail fuel injection apparatus capable of changing the injection pressure of fuel injected from the injector as requested even if component parts are not processed at such a high precision as needed in the common rail fuel injection apparatus described in Japanese Patent No. 2885076.

This invention provides a common rail fuel injection apparatus capable of changing an injection pressure of a fuel injected from an injector, as described below. That is, the common rail fuel injection apparatus includes a piston for increasing the injection pressure of the injector, a chamber for controlling a position of the piston so as to control the injection pressure, an input constriction that sets an amount of flow of the fuel that enters the chamber, an out put constriction that sets an amount of flow of the fuel that exits from the chamber, and a valve that controls a passage of the fuel from a common rail to the input constriction.

In the common rail fuel injection apparatus, the input constriction is provided to set the amount of flow of fuel that enters the chamber provided for controlling the position of the piston, and the output constriction is provided to set the amount of flow of fuel that exits from the chamber. Furthermore, the input constriction is connected to the common rail via the valve. That is, unlike the case of the pressure-increasing piston described in Japanese Patent No. 2885076, whether the fuel pressure in the injector is increased or not is not greatly dependent on the relative position of the piston with respect to a pressure reducing passage. That is, whether the lift of the piston is reduced is determined in accordance with whether the valve is in the closed valve state. Furthermore, whether the lift of the piston is increased is determined in accordance with whether the valve is in the open valve state. More specifically, if the valve is closed, the amount of flow of fuel that exits from the chamber becomes greater than the amount of flow of fuel that enters the chamber, so that the lift of the piston reduces and the fuel pressure in the injector reduces. Conversely, if the valve is opened, the amount of flow of fuel that exits from the chamber becomes less than the amount of flow of fuel that enters the chamber, so that the lift of the piston increases and the fuel pressure in the injector increases. Therefore, it becomes possible to change the injection pressure of fuel injected from the injector as requested without a need to process component parts with high precision as required for the common rail fuel injection apparatus described in Japanese Patent No. 2885076.

For example, if the valve is formed by a two-way valve, it is possible to change the injection pressure of fuel injected from the injector as requested while employing a simpler construction than the common rail fuel injection apparatus employing a three-way valve as described in Japanese Patent No. 2885076.

BRIEF DESCRIPTION OF THE DRAWINGS

The above and other objects, features, advantages, technical and industrial significance of this invention will be better understood by reading the following detailed description of preferred embodiments of the invention, when considered in connection with the accompanying drawings, in which.

DETAILED DESCRIPTION OF PREFERRED EMBODIMENTS

In the following description and the accompanying drawings, the present invention will be described in more detail in terms of preferred embodiments.

Figure 1:
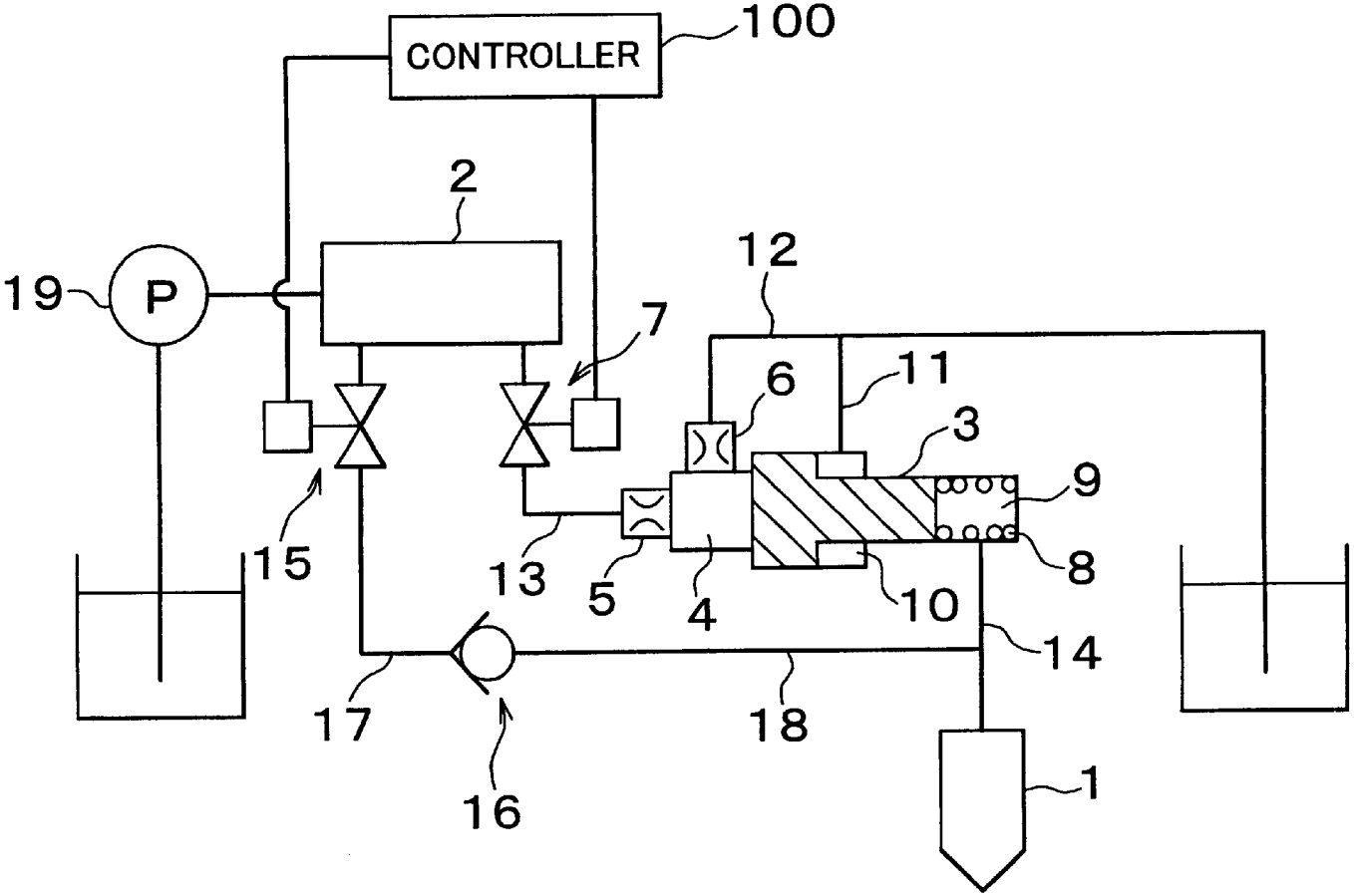
FIG. 1 is a diagram schematically illustrating the construction of a first embodiment of the common rail fuel injection apparatus of the invention.

FIG. 1 is a schematic diagram illustrating a construction of a first embodiment of the common rail fuel injection apparatus of the invention. FIG. 1 shows a known type of injector 1 that is designed so that a needle valve can control fuel injection based on an electric signal, as well as a common rail 2 for accumulating a predetermined pressure of fuel, and a pressure-increasing piston 3 for further increasing the fuel pressure accumulated in the common rail 2. The fuel whose pressure has been increased by the pressure-increasing piston 3 is injected from the injector 1 at a higher injection pressure than the fuel whose pressure has not been increased by the pressure-increasing piston 3. Furthermore, a control chamber 4 is provided for controlling the position of the pressure-increasing piston 3 in order to control the injection pressure. An inlet constricted portion 5 is provided for setting the amount of flow of fuel that enters the control chamber 4. An outlet constricted portion 6 is provided for setting an amount of flow of fuel that exits from the control chamber 4. A pressure increase control valve 7 is provided for controlling whether to increase the fuel injection pressure, that is, whether to supply fuel from the common rail 2 to the control chamber 4. The degree of constriction of the inlet constricted portion 5 and the degree of constriction of the outlet constricted portion 6 are set so that the lift of the pressure-increasing piston 3 increases when the pressure increase control valve 7 is open. A spring 8 is provided for urging the pressure-increasing piston 3 in such a direction as to reduce the injection pressure. A high-pressure chamber 9 is provided so that the pressure in the high-pressure chamber 9 is increased by the pressure-increasing piston 3. A low-pressure chamber 10 is also provided.

The pressure increase control valve 7 and the fuel supply control valve 15 are controlled by a controller 100 that responds to the operating conditions of the system that includes the common rail fuel injection apparatus. The controller 100 is implemented as a programmed general purpose computer. It will be appreciated by those skilled in the art that the controller 100 can be implemented using a single special purpose integrated circuit (e.g., ASIC) having a main or central processor section for overall, system-level control, and separate sections dedicated to performing various different specific computations, functions and other processes under control of the central processor section. The controller 100 can be a plurality of separate dedicated or programmable integrated or other electronic circuits or devices (e.g., hard wired electronic or logic circuits such as discrete element circuits, or programmable logic devices such as PLDS, PLAs, PALs or the like). The controller 100 can be implemented using a suitably programmed general purpose computer, e.g., a microprocessor, microcontroller or other processor device (CPU or MPU), either alone or in conjunction with one or more peripheral (e.g., integrated circuit) data and signal processing devices. In general, any device or assembly of devices on which a finite state machine capable of implementing the procedures described herein can be used as the controller. A distributed processing architecture can be used for maximum data/signal processing capability and speed.

A return passage 11 is provided for returning fuel from the low-pressure chamber 10. A return passage 12 is provided for returning fuel from the control chamber 4. A pressure-increasing fuel supplying passage 13 connects the common rail 2 and the control chamber 4. A fuel passage 14 is provided so that the pressure in the high-pressure chamber 9 is increased when the lift of the pressure-increasing piston 3 is increased (the pressure-increasing piston 3 is moved to the right in FIG. 1). A fuel supply control valve 15 is provided for controlling whether to supply fuel from the common rail 2 to the injector 1. FIG. 1 further shows a check valve 16, a fuel supply passage 17 connecting the common rail 2 and the check valve 16, a fuel passage 18 provided so that the pressure therein is increased when the lift of the pressure-increasing piston 3 is increased, and a pump 19 for supplying pressurized fuel to the common rail 2.

Figure 2:
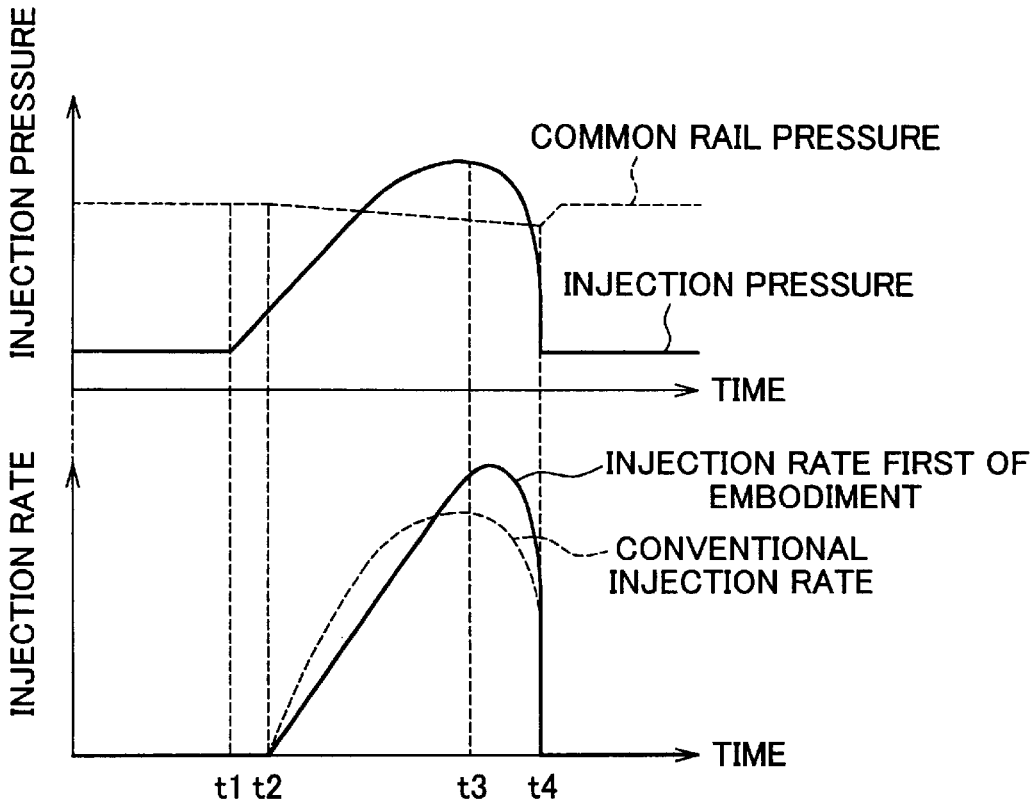
FIG. 2 is a diagram illustrating a relationship between the fuel injection pressure and time, and a relationship between the fuel injection rate and time, in the common rail fuel injection apparatus of the first embodiment.

FIG. 2 is a diagram illustrating a relationship between the fuel injection pressure and time, and a relationship between the fuel injection rate and time. In FIG. 2, if fuel is being injected from the injector 1, the "injection pressure" means the pressure of fuel injected. If fuel is not being injected from the injector 1, the "injection pressure" means the pressure of fuel present in the high-pressure chamber 9, and the pressure of the fuel present in the passages 14, 18. A solid line in an upper portion of FIG. 2 indicates the injection pressure, and a broken line in the upper portion of FIG. 2 indicates the pressure in the common rail 2. A solid line in a lower portion of FIG. 2 indicates the injection rate of the common rail fuel injection apparatus of a first embodiment, and a broken line in the lower portion of FIG. 2 indicates the injection rate of a conventional common rail fuel injection apparatus that is not equipped with a pressure-increasing piston 3.

As can be seen from FIGS. 1 and 2, the injection pressure is relatively low and the injection rate is zero during a period preceding a time t1 during which the pressure increase control valve 7, the fuel supply control valve 15 and the injector 1 are in a closed-valve state. At the time t1, the pressure increase control valve 7 and the fuel supply control valve 15 are opened, so that fuel is supplied into the fuel passages 18, 14 and the high-pressure chamber 9, via the check valve 16. Furthermore, fuel is supplied into the control chamber 4 via the inlet constricted portion 5, so that the lift of the pressure-increasing piston 3 increases (the pressure-increasing piston 3 is moved toward the right in FIG. 1). As a result, the fuel in the high-pressure chamber 9 and the fuel passages 14, 18 is pressurized, so that the injection pressure starts to increase. Subsequently, at a time t2 when the injector 1 is opened, fuel injection starts, and the injection rate increases as the injection pressure increases. According to the first embodiment, the injection pressure before the time t1 is set at a relatively low value, so that the initial injection rate can be held lower than in the conventional art. Therefore, the first embodiment is able to reduce the amount of NOx produced in and discharged from the internal combustion engine in comparison with the conventional art. Further, in the first embodiment, the fuel in the high-pressure chamber 9 and the fuel passages 14, 18 is pressurized to a higher pressure by the pressure-increasing piston 3 than the fuel in the common rail 2. Therefore, the maximum (peak) injection pressure and the maximum (peak) injection rate can be made higher than in the conventional art that is not equipped with a pressure-increasing piston. Therefore, this embodiment makes it possible to increase the output of the internal combustion engine for which the common rail fuel injection apparatus of this invention is installed, in comparison with the conventional art.

Next, at a time t3 when the pressure increase control valve 7 and the fuel supply control valve 15 are closed, the supply of fuel into the high-pressure chamber 9 and the fuel passages 14, 18 discontinues, whereas fuel from the high-pressure chamber 9 and the fuel passages 14, 18 continues to be injected via the injector 1. As a result, the injection pressure decreases and the injection rate decreases. In the first embodiment, the inlet constricted portion 5 and the outlet constricted portion 6 are designed so as to rapidly reduce the injection pressure and thereby rapidly reduce the injection rate. Therefore, the injection rate can be more quickly reduced than in the conventional art. Hence, the amount of HC produced in and discharged from the internal combustion engine can be reduced in comparison with the conventional art. Subsequently at a time t4 when the injector 1 is closed, the injection rate becomes zero.

Figure 3A:
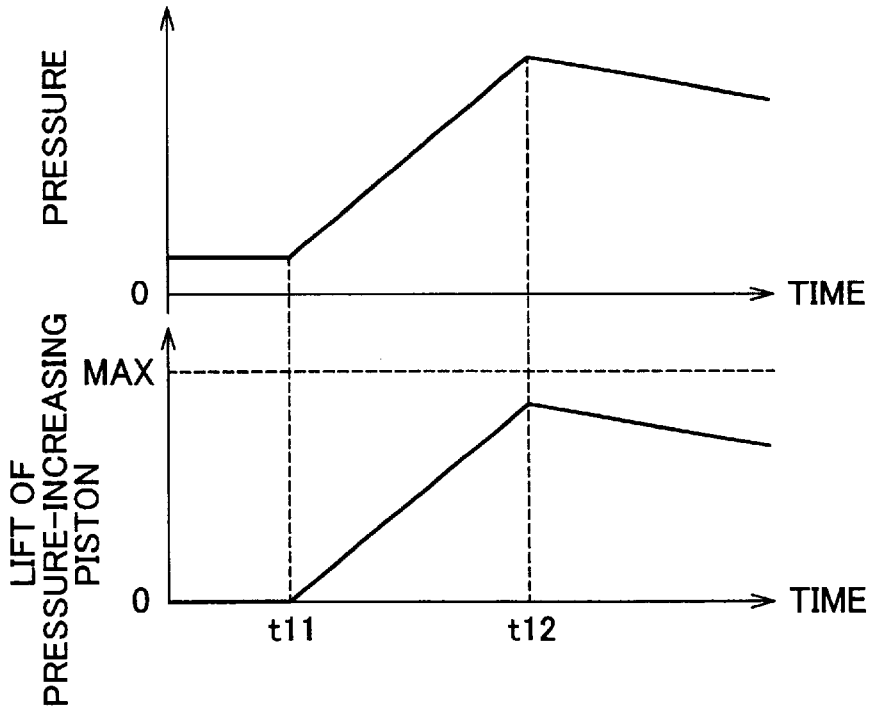
FIG. 3*a* is a diagram illustrating a relationship between the lift of a pressure-increasing piston and time in the common rail fuel injection apparatus of the first embodiment.
Figure 3B:
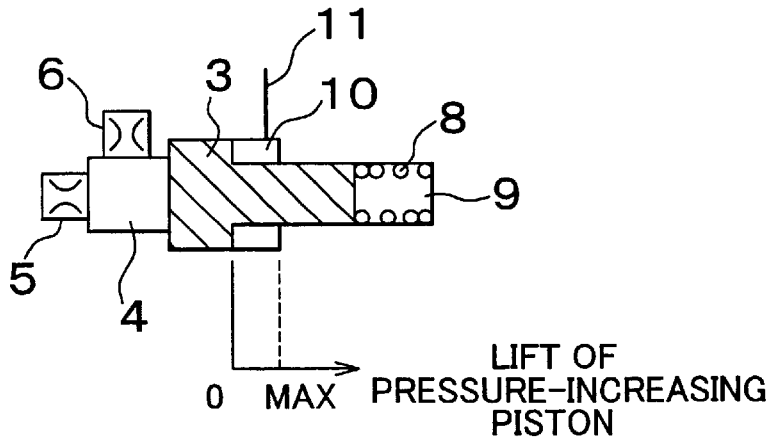
FIG. 3*b* is a diagram illustrating the amount of lift of the pressure-increasing piston in the common rail fuel injection apparatus of the first embodiment.

FIG. 3*a* is a diagram illustrating a relationship between the injection pressure and time, and a relationship between the lift of the pressure-increasing piston and time. FIG. 3*b* is a diagram illustrating the position of the pressure-increasing piston. More specifically, FIG. 3*a* indicates the pressure of fuel in the high-pressure chamber 9 and the fuel passages 14, 18 occurring when the lift of the pressure-increasing piston 3 is changed while a closed valve state of the injector 1 is maintained. As indicated in FIG. 3*a*, the pressure of fuel in the high-pressure chamber 9 and the fuel passages 14, 18 increases as the lift of the pressure-increasing piston 3 is increased. The pressure of fuel in the high-pressure chamber 9 and the fuel passages 14, 18 decreases as the lift of the pressure-increasing piston 3 is decreased. That is, in the first embodiment, the pressure of fuel in the high-pressure chamber 9 and the fuel passages 14, 18 can be changed by changing the lift of the pressure-increasing piston 3. Furthermore, the lift of the pressure-increasing piston 3 can be changed by changing the pressure increase control valve 7 between an open valve state and a closed valve state.

According to the first embodiment, whether the pressure of fuel in the high-pressure chamber 9 and the fuel passages 14, 18 is to be decreased or increased is not greatly dependent on the relative position of the pressure-increasing piston with respect to the pressure reduction passage, but is determined by whether the pressure increase control valve 7 is closed or opened, unlike the common rail fuel injection apparatus described in Japanese Patent No. 2885076. Therefore, the first embodiment allows the injection pressure of fuel injected from the injector 1 to be changed as requested without a need to process component parts with such a high precision as in the common rail fuel injection apparatus described in Japanese Patent No. 2885076.

Furthermore, due to the design of the inlet constricted portion 5 and the outlet constricted portion 6 according to the first embodiment, the injection pressure can be quickly reduced when the pressure increase control valve 7 is closed.

Figure 4:
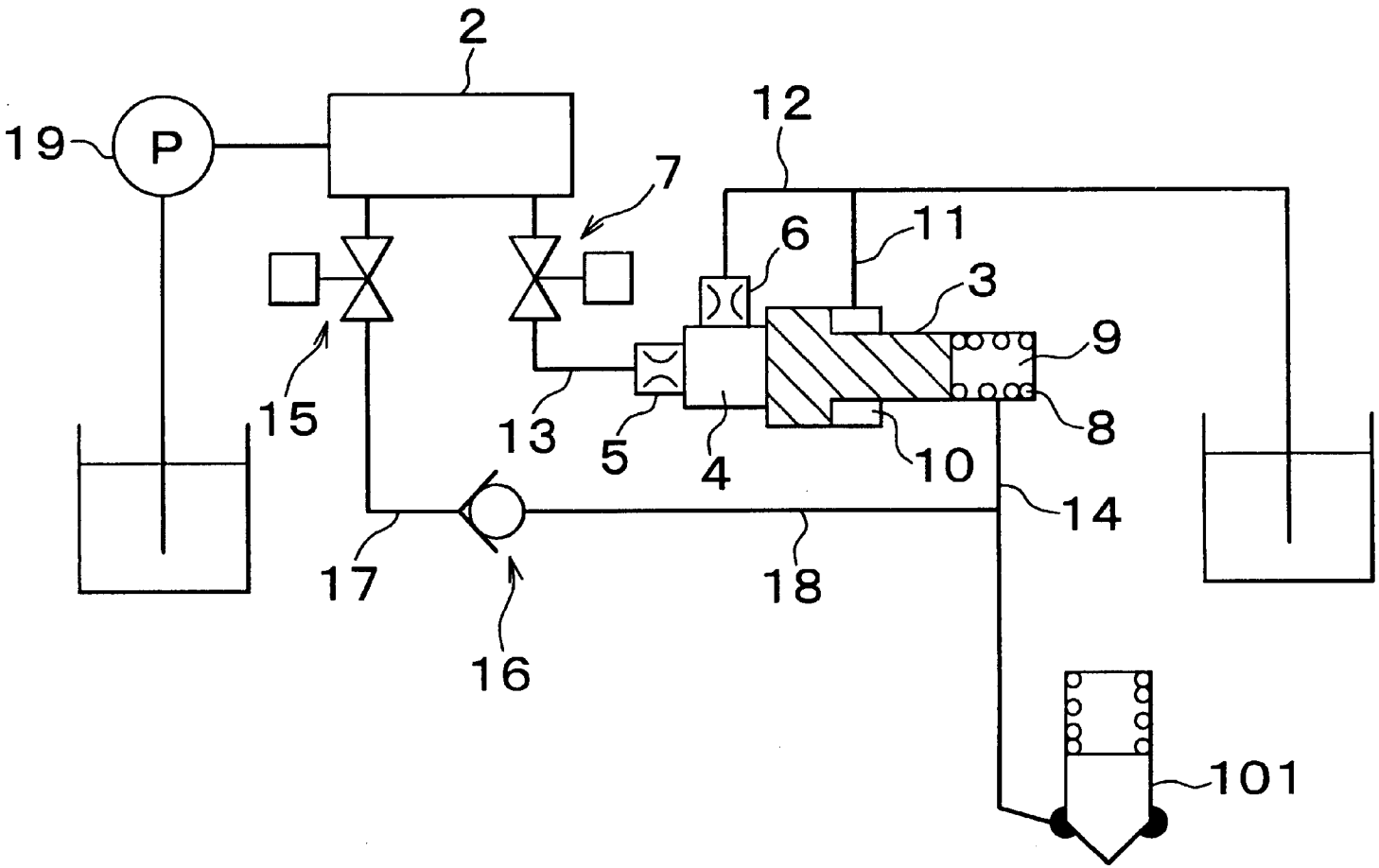
FIG. 4 is a diagram schematically illustrating the construction of a first modification of the first embodiment.

A first modification of the first embodiment of the common rail fuel injection apparatus of the invention will be described below. FIG. 4 is a diagram schematically illustrating the construction of the first modification of the first embodiment. In FIG. 4, the same reference numbers as those used in FIG. 1 indicate the same component parts or portions as those shown in FIG. 1. Thus, the first modification can achieve substantially the same advantages as those of the first embodiment. In FIG. 4, reference numeral 101 represents a known jerk-type nozzle. In the first embodiment, the injector nozzle 1 is opened when the needle valve is electromagnetically lifted. In contrast, in the first modification, the injector nozzle 101 is opened when the pressure of fuel in a fuel reservoir of the injector 101 exceeds a predetermined value as the pressure of fuel in the high-pressure chamber 9 and the fuel passages 14, 18 increases.

Figure 5:
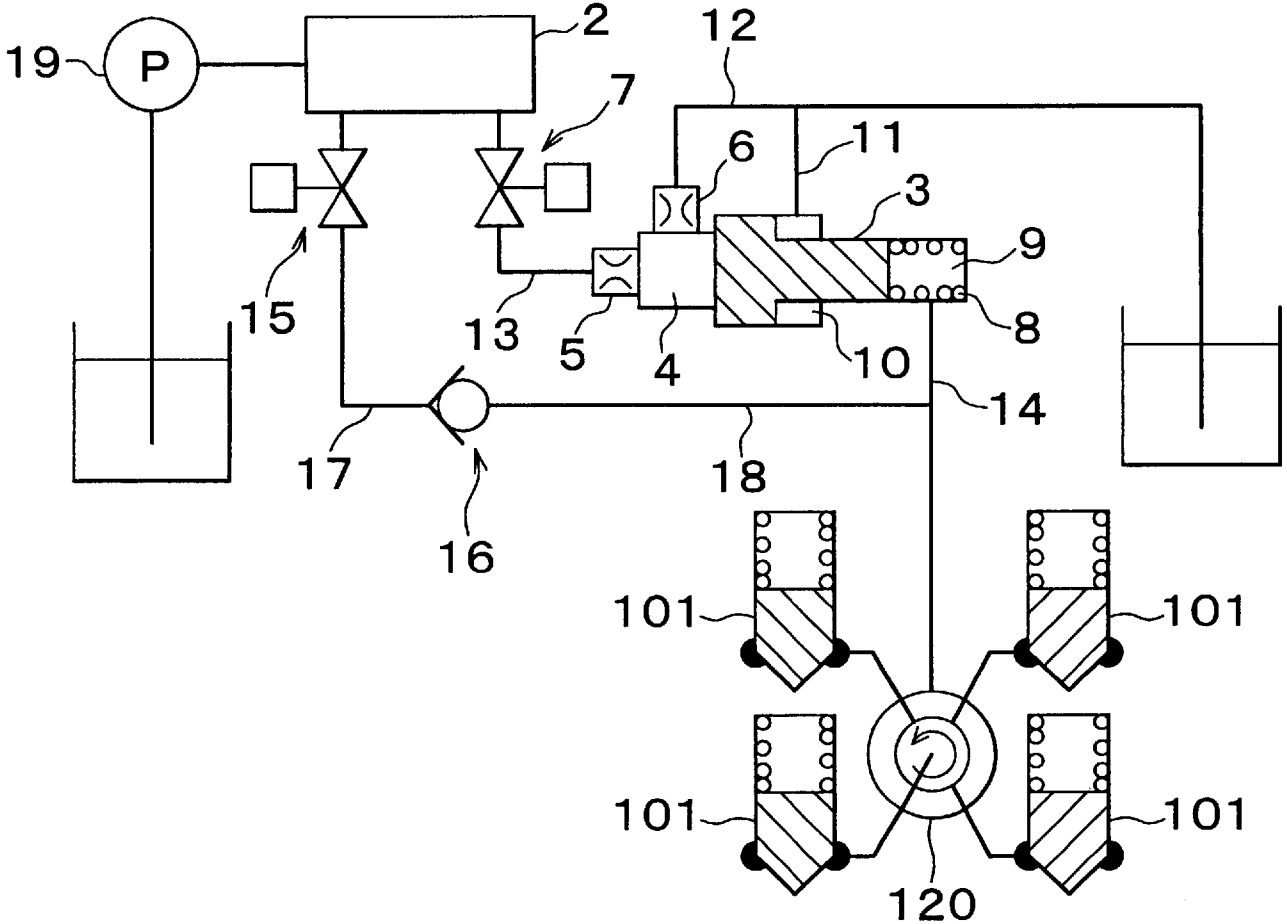
FIG. 5 is a diagram schematically illustrating the construction of a second modification of the first embodiment.

A second modification of the first modification of the common rail fuel injection apparatus of the invention will be described below. FIG. 5 is a diagram schematically illustrating the construction of the second modification of the first embodiment. In FIG. 5, the same reference numbers as those used in FIGS. 1 and 2 indicate the same component parts or portions as those shown in FIGS. 1 and 4. Thus, the second modification can achieve substantially the same advantages as those of the first embodiment. In FIG. 5, reference numeral 120 represents a distributor. This construction makes it possible to control the injectors of a plurality of cylinders without a need to increase the number of electromagnetic valves such as the pressure increase control valve 7 and the like.

Figure 6:
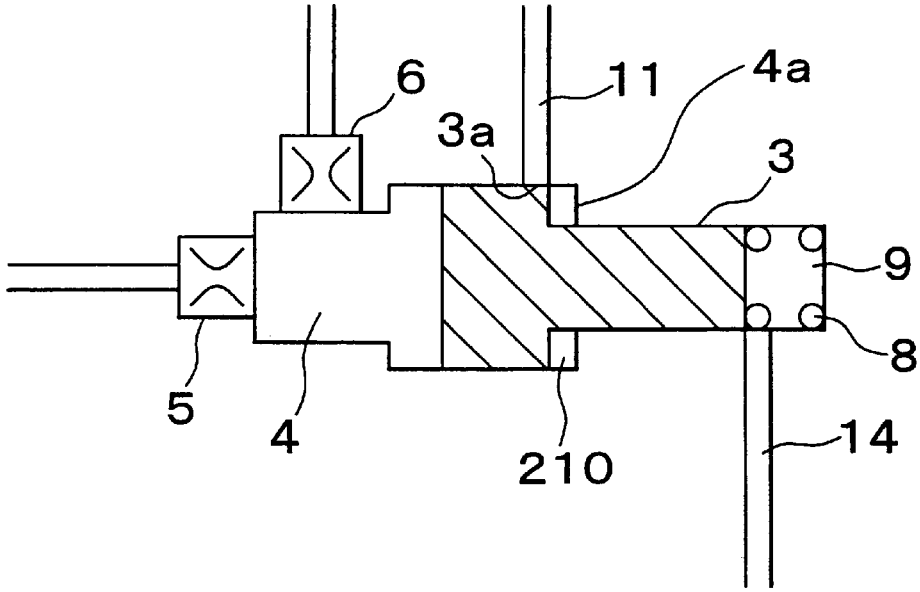
FIG. 6 is a diagram schematically illustrating portions of a second embodiment.

A second embodiment of the common rail fuel injection apparatus of the invention will be described below. The construction of the second embodiment is substantially the same as that of the first embodiment, except features or the like described below. Therefore, the second embodiment achieves substantially the same advantages as those of the first embodiment. FIG. 6 is a diagram schematically illustrating portions of the second embodiment. In FIG. 6, the same reference numbers as those used in FIG. 1 indicate the same component parts or portions as those shown in FIG. 1. In FIG. 6, reference numeral 210 represents a closed sub-chamber. During a period during which the pressure increase control valve 7 is closed, a pressure-increasing piston 3 is impinged on the left-side end by a spring 8 as indicated in FIG. 1. When a pressure increase control valve 7 is opened, the pressure-increasing piston 3 is urged toward the right by the pressure of fuel in a control chamber 4, so that the lift of the pressure-increasing piston 3 starts to increase. As the lift of the pressure-increasing piston 3 increases, a side surface 3*a* of the pressure-increasing piston 3 closes an inlet of a return passage 11, so that the closed sub-chamber 210 is formed as indicated in FIG. 6. This closed chamber 210 prevents a strong impingement of the pressure-increasing piston 3 against a right-side end, thereby preventing breakage of the pressure-increasing piston 3 and a stopper portion 4*a* on which the pressure-increasing piston 3 impinges.

Figure 7:
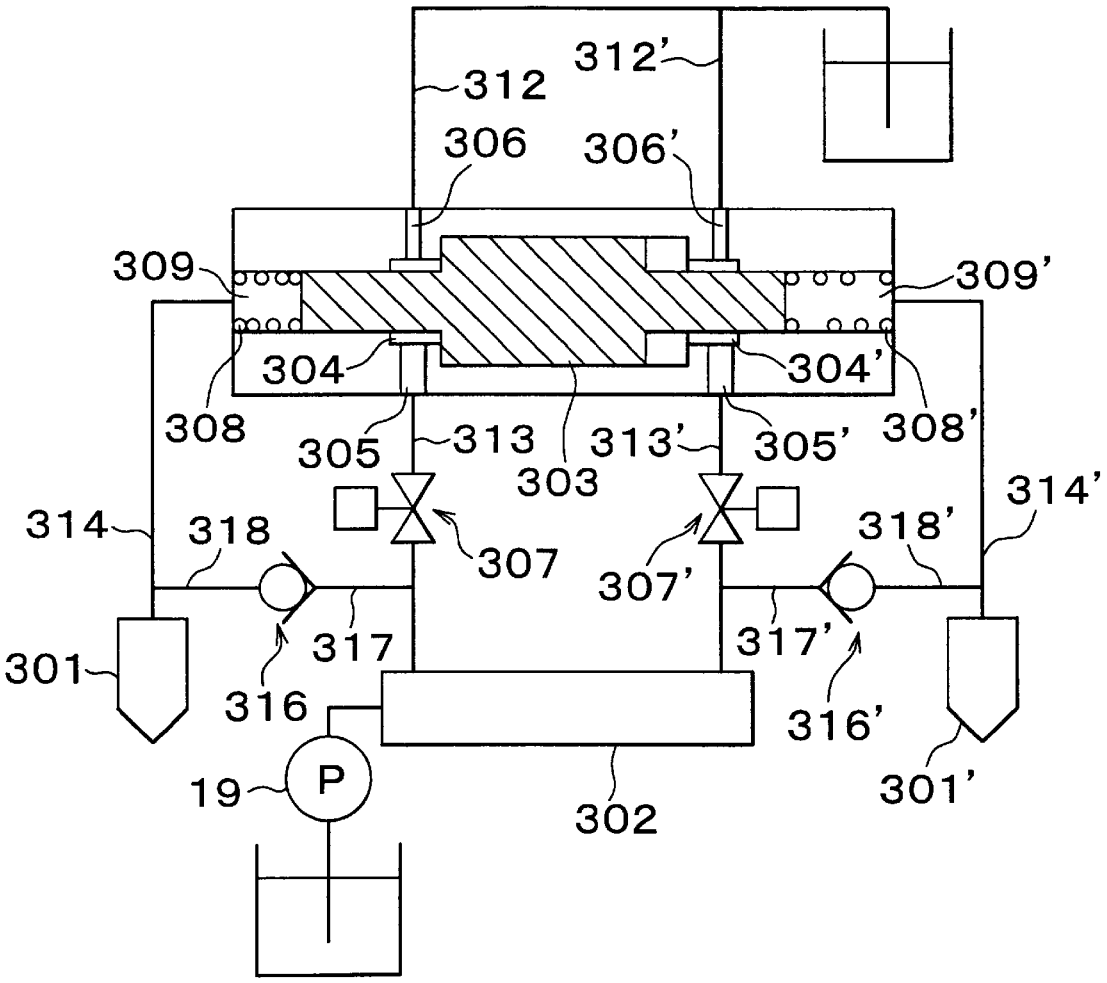
FIG. 7 is a diagram schematically illustrating the construction of a third embodiment.

A third embodiment of the common rail fuel injection apparatus of the invention will be described below. The construction of the third embodiment is substantially the same as that of the first embodiment, except features or the like described below. Therefore, the third embodiment achieves substantially the same advantages as those of the first embodiment. FIG. 7 is a diagram schematically illustrating the construction of the third embodiment. In FIG. 7, the same reference numbers as those used in FIG. 1 indicate the same component parts or portions as those shown in FIG. 1. As shown in FIG. 7, the third embodiment includes a first injector 301 of a known type in which a needle valve is electromagnetically driven, a second injector 301' constructed substantially in the same manner as the first injector 301, a common rail 302 for accumulating a predetermined pressure of fuel, and a two-direction pressure-increasing piston 303 for further increasing the pressure of fuel accumulated in the common rail 302. Similar to the first embodiment, the fuel whose pressure has been increased by the two-direction pressure-increasing piston 303 is injected from the first injector 301 or the second injector 301' at a higher injection pressure than the fuel whose pressure is not pressurized by the pressure-increasing piston 3.

Furthermore, a first control chamber 304 is provided for urging the two-direction pressure-increasing piston 303 rightwards in order to increase the injection pressure of the second injector 301', and a second control chamber 304' is provided for urging the two-direction pressure-increasing piston 303 leftwards in order to increase the injection pressure of the first injector 301. An inlet constricted portion 305 is provided for setting an amount of flow of fuel that enters the first control chamber 304. An inlet constricted portion 305' is provided for setting an amount of flow that enters the second control chamber 304'. An outlet constricted portion 306 is provided for setting an amount of flow of fuel that exits from the first control chamber 304. An outlet constricted portion 306' is provided for setting an amount of flow of fuel that exits from the second control chamber 304'. Pressure increase control valves 307,307' are provided for controlling whether to increase the injection pressure, that is, whether to supply fuel from the common rail 302 to the first control chambers 304,304'. That is, to move the two-direction pressure-increasing piston 303 rightwards, the pressure increase control valve 307 is opened and the pressure increase control valve 307' is closed. To move the two-direction pressure-increasing piston 303 leftwards, the pressure increase control valve 307' is opened and the pressure increase control valve 307 is closed. The degree of constriction of the inlet constricted portion 305 and the degree of constriction of the outlet constricted portion 306 are set so that the two-direction pressure-increasing piston 303 is moved rightwards when the pressure increase control valve 307 is opened. Likewise, the degree of constriction of the inlet constricted portion 305' and the degree of constriction of the outlet constricted portion 306' are set so that the two-direction pressure-increasing piston 303 is moved leftwards when the pressure increase control valve 307' is opened. A spring 308 is provided for urging the two-direction pressure-increasing piston 303 rightwards. A spring 308' is provided for urging the two-direction pressure-increasing piston 303 leftwards. High-pressure chambers 309,309' are provided so that the pressure therein is increased by the two-direction pressure-increasing piston 303.

A return passage 312 is provided for returning fuel from the control chamber 304. A return passage 312' is provided for returning fuel from the control chamber 304'. A pressure-increasing fuel supplying passage 313 connects the common rail 302 and the control chamber 304. A pressure-increasing fuel supplying passage 313' connects the common rail 302 and the control chamber 304'. A fuel passage 314 is provided so that the pressure therein is increased when the pressure-increasing piston 303 is moved leftwards. A fuel passage 314' is provided so that the pressure therein is increased when the pressure-increasing piston 303 is moved rightwards. FIG. 7 further shows check valves 316,316', a fuel supply passage 317 connecting the common rail 302 and the check valve 316, and a fuel supply passage 317' connecting the common rail 302 and the check valve 316'. Furthermore, a fuel passage 318 is provided so that the pressure therein is increased when the pressure-increasing piston 303 is moved leftwards. A fuel passage 318' is provided so that the pressure therein is increased when the pressure-increasing piston 303 is moved rightwards.

According to the third embodiment, the two-direction pressure-increasing piston 303 is designed so that the injection pressure of fuel injected from the first injector 301 is increased when the two-direction pressure-increasing piston 303 is moved leftward, and so that the injection pressure of fuel injected from the second injector 301' is increased when the two-direction pressure-increasing piston 303 is moved rightwards. Therefore, using the single pressure-increasing piston 303, the injection pressure of the injectors 301,301' can be changed.

Furthermore, according to the third embodiment, a leftwards small-diameter portion of the pressure-increasing piston 303 for pressurizing fuel in the first injector 301 and a rightwards small-diameter portion of the pressure-increasing piston 303 for pressurizing fuel in the second injector 301' are disposed in a straight line and are oriented in opposite directions. Therefore, the injection pressures of the injectors 301,301' can easily be changed by simple movements of the two-direction pressure-increasing piston 303, that is, linear movements of the pressure-increasing piston 303.

Still further, according to the third embodiment, when the fuel injection from the first injector 301 is completed, the two-direction pressure-increasing piston 303 has already been positioned at an initial position for starting fuel injection from the second injector 301'. That is, there is no need to provide a special step for returning the two-direction pressure-increasing piston 303 to the initial position in order to start the fuel injection from the second injector 301'. Therefore, the interval between the pressure increasing steps can be reduced, so that good performance can be achieved during high-speed operation of the internal combustion engine as well. Furthermore, if the pressure increase control valves 307,307' are simultaneously opened, a function as a pressure reducing valve can also be achieved.

Figure 8:
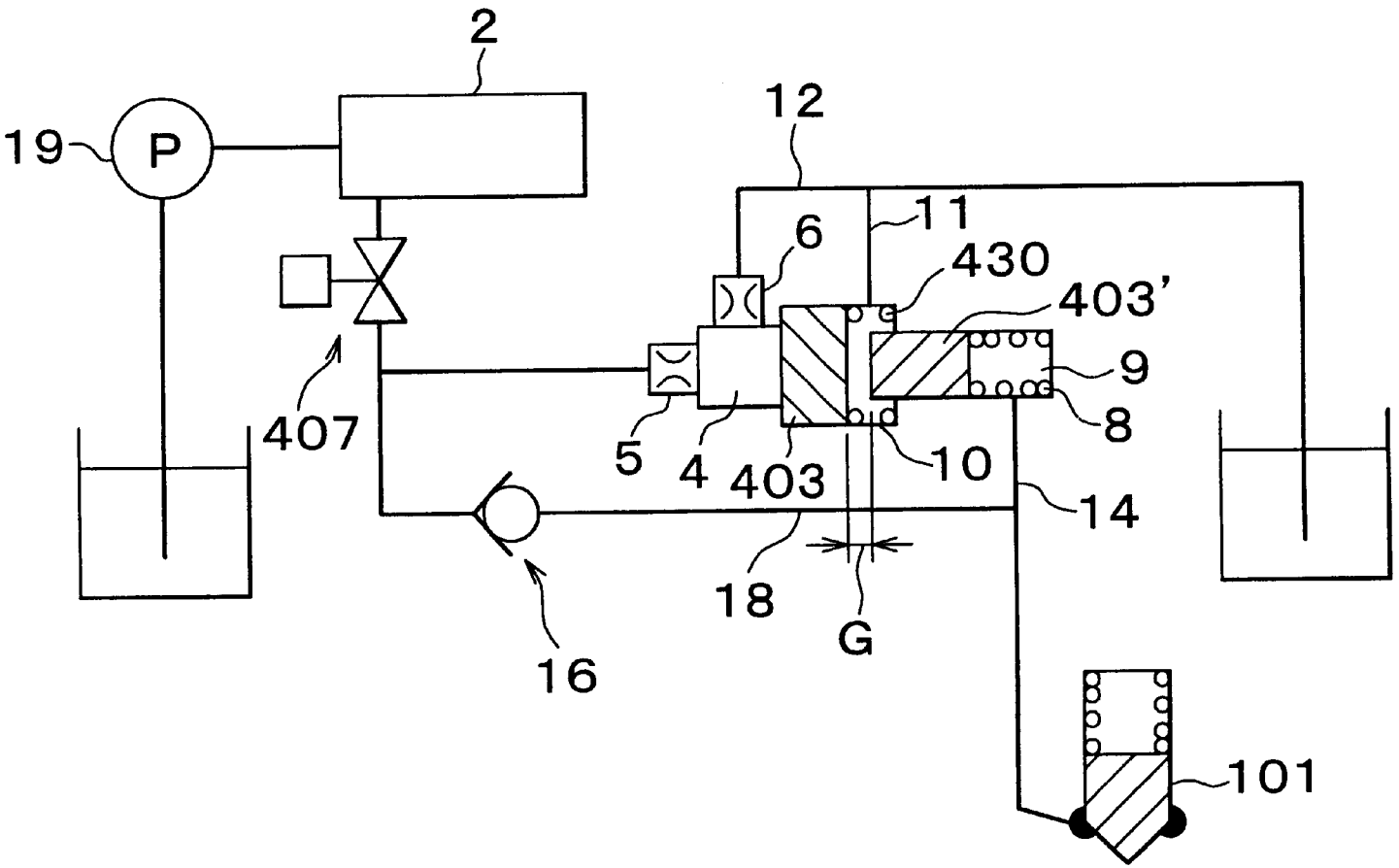
FIG. 8 is a diagram schematically illustrating the construction of a fourth embodiment.

A fourth embodiment of the common rail fuel injection apparatus of the invention will be described below. FIG. 8 is a diagram schematically illustrating the construction of the fourth embodiment. In FIG. 8, the same reference numbers as those used in FIGS. 1 and 4 indicate the same component parts or portions as those shown in FIGS. 1 and 4. Therefore, the fourth embodiment achieves substantially the same advantages as those achieved by the first embodiment. Referring to FIG. 8, the fourth embodiment includes a large-diameter piston 403 that forms a portion of a pressure-increasing piston for further increasing the pressure of fuel accumulated in a common rail 2, and a small-diameter portion 403' that forms another portion of the pressure-increasing piston. A spring 430 is provided for urging the large-diameter piston 403 toward a zero-lift position (a position where the large-diameter piston 403 is impinged on a left-side end in FIG. 8). A pressure increase control valve 407 is provided for controlling whether to increase the injection pressure. That is, whether to supply fuel from the common rail 2 to a control chamber 4. The forces of springs 430, 8 are set so that a gap G is formed between the large-diameter piston 403 and the small-diameter portion 403' when the pressure increase control valve 407 is closed. The pressure increase control valve 407 also controls whether to supply fuel from the common rail 2 to an injector 101.

According to the fourth embodiment, the pressure-increasing piston is divided into the large-diameter piston 403 and the small-diameter portion 403'. The large-diameter piston 403 and the small-diameter portion 403' are disposed so that the gap G is formed between the large-diameter piston 403 and the small-diameter portion 403' during a period during which the pressure increase control valve 407 is in a closed valve state. That is, the gap G is present between the large-diameter piston 403 and the small-diameter portion 403' when the pressure increase control valve 407 is changed from the closed valve state to the open valve state. Therefore, the lift of the small-diameter portion 403' is not immediately increased after the lift of the large-diameter piston 403 starts to increase. Hence, the injection pressure of the injector 101 can be increased at a retarded timing of starting to increase the injection pressure of the injector 101. That is, the pressure of fuel in the high-pressure chamber 9 and the fuel passages 14, 18 can be increased at a retarded timing of starting to increase the pressure of fuel in the high-pressure chamber 9 and the fuel passages 14, 18.

Figure 9:
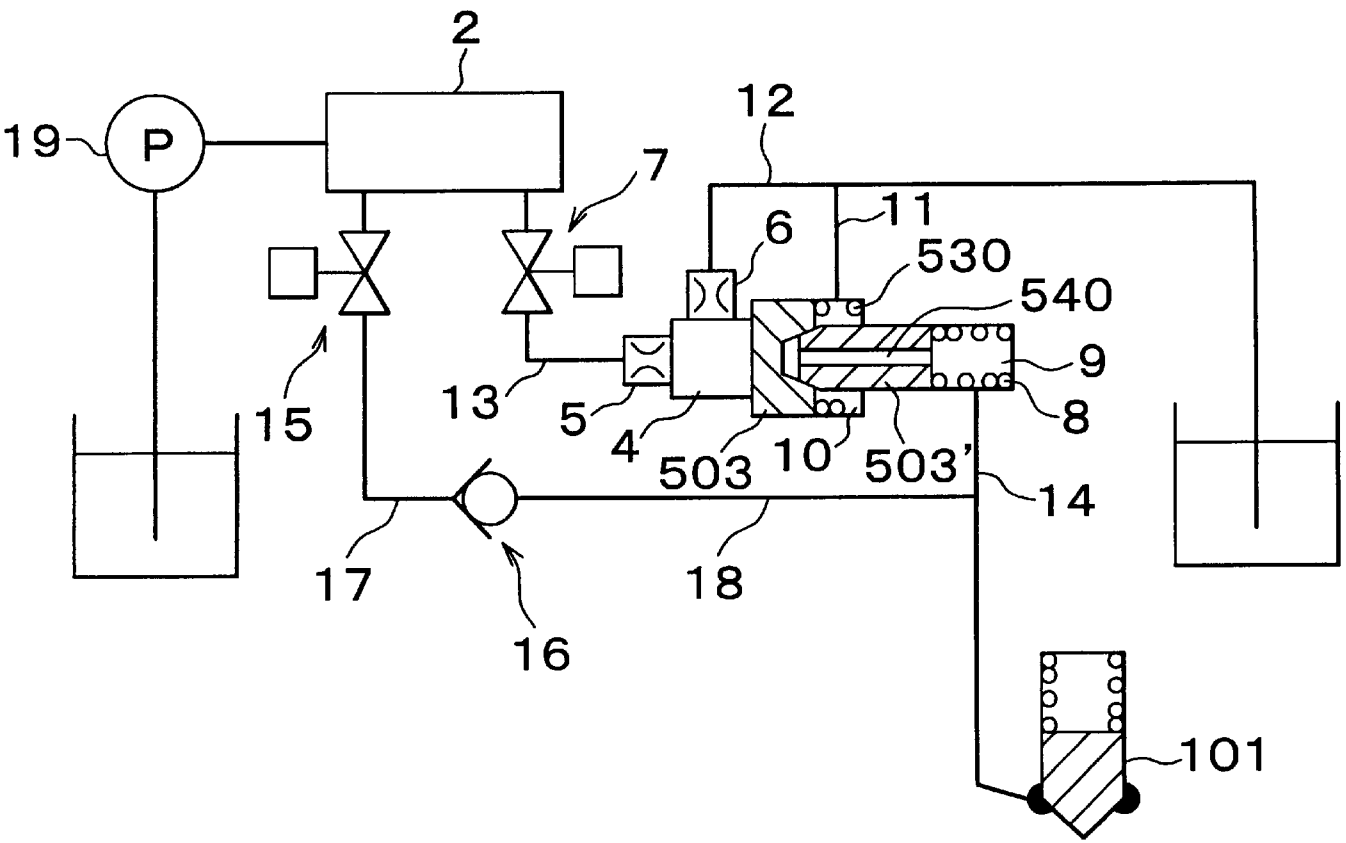
FIG. 9 is a diagram schematically illustrating the construction of a fifth embodiment.
Figure 10:
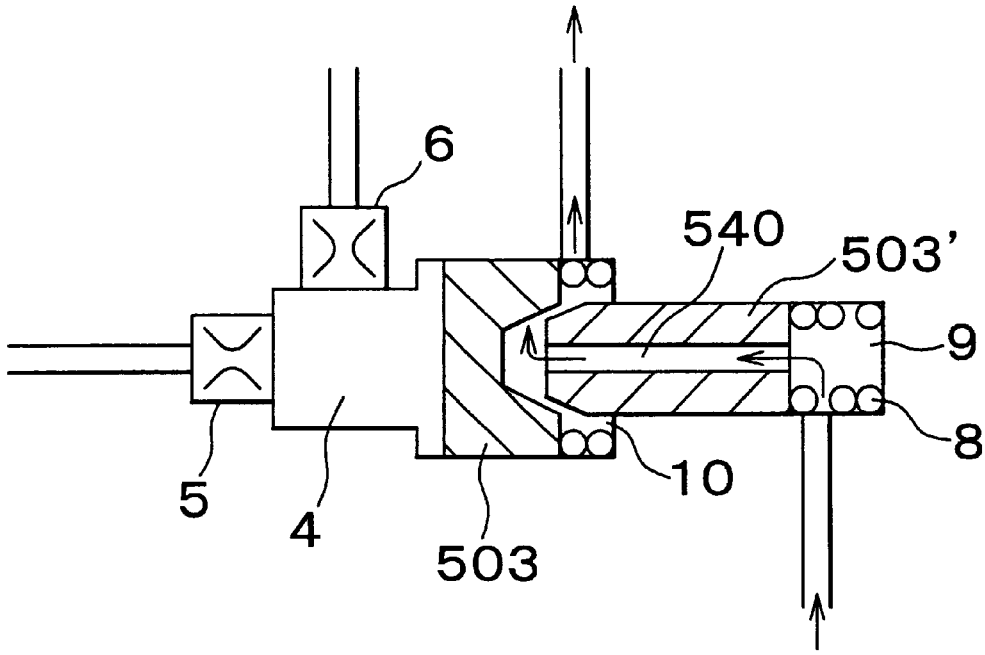
FIG. 10 is an enlarged view of a portion of the fifth embodiment.

A fifth embodiment of the common rail fuel injection apparatus of the invention will be described below. FIG. 9 is a diagram schematically illustrating a construction of the fifth embodiment. FIG. 10 is an enlarged view of a portion of the fifth embodiment. In FIGS. 9 and 10, the same reference numbers as those used in FIGS. 1 and 4 indicate the same component parts or portions as those shown in FIGS. 1 and 4. Therefore, the fifth embodiment achieves substantially the same advantages as those achieved by the first embodiment. Referring to FIGS. 9 and 10, the fifth embodiment includes a first pressure-increasing piston 503 that forms a portion of a pressure-increasing piston for further increasing the pressure of fuel accumulated in a common rail 2, and a hollow second pressure-increasing piston 503' that forms another portion of the pressure-increasing piston. A spring 530 is provided for urging the first pressure-increasing piston 503 toward a zero-lift position (a position where the first pressure-increasing piston 503 is impinged on a left-side end in FIG. 9). A fuel passage hole 540 is formed in the second pressure-increasing piston 503'.

The weight of the first pressure-increasing piston 503 and the weight of the second pressure-increasing piston 503' and the forces from the springs 530, 8 are set so that the first pressure-increasing piston 503 is moved more quickly to the left in FIG. 9 than the second pressure-increasing piston 503' when the pressure increase control valve 7 is changed from an open valve state to a closed valve state. That is, the first pressure-increasing piston 503, the hollow second pressure-increasing piston 503' and the springs 530, 8 form a relief mechanism that is operated when the pressure increase control valve 7 is changed from the open valve state to the closed valve state.

Figure 11:
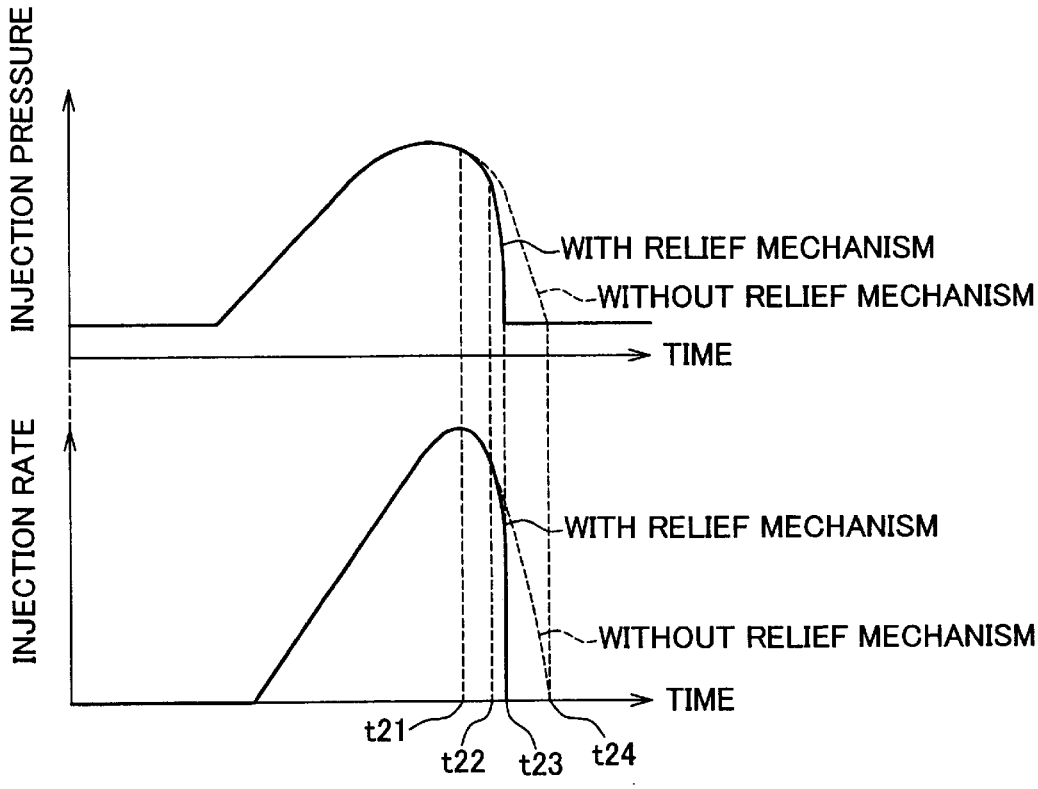
FIG. 11 is a diagram illustrating the injection pressure and the injection rate in a common rail fuel injection apparatus equipped with a relief mechanism as in the fifth embodiment in comparison with the injection pressure and the injection rate in a common rail fuel injection apparatus that is not equipped with a relief mechanism.

FIG. 11 indicates the injection pressure and the injection rate in a common rail fuel injection apparatus equipped with the relief mechanism as in the fifth embodiment in comparison with the injection pressure and the injection rate in a common rail fuel injection apparatus that is not equipped with a relief mechanism. In FIG. 11, solid lines indicate the injection pressure and the injection rate of the common rail fuel injection apparatus equipped with the relief mechanism, and broken lines indicate the injection pressure and the injection rate of the common rail fuel injection apparatus that is not equipped with a relief mechanism. As indicated in FIG. 11, if the relief mechanism is provided as in the fifth embodiment, the injection pressure and the injection rate start to decrease at a time t21 when the pressure increase control valve 7 and the fuel supply control valve 15 are closed. Subsequently at a time t22 when the first pressure-increasing piston 503 and the second pressure-increasing piston 503' separate from each other as indicated in FIG. 10, fuel in the high-pressure chamber 9 and the fuel passages 14, 18 is relieved, and the injection pressure and the injection rate start to sharply fall. As a result, the injection rate reaches zero at a time T23. Thus, the relief mechanism-equipped common rail fuel injection apparatus is able to more quickly reduce the injection pressure and the injection rate than the common rail fuel injection apparatus not equipped with a relief mechanism, whose injection rate becomes equal to zero at a time t24.

According to the fifth embodiment, the first pressure-increasing piston 503, the hollow second pressure-increasing piston 503' and the springs 530, 8 are provided as the relief mechanism for reducing the fuel pressure in the injector 101 when the pressure increase control valve 7 is changed from the open valve state to the closed valve state. More specifically, when the pressure increase control valve 7 is changed from the open valve state to the closed valve state, the low-pressure chamber 10, the fuel passage hole 540, the high-pressure chamber 9 and the fuel passage 14 between the injector 101 and the return passage 11 are connected in communication. That is, when the first pressure-increasing piston 503 and the second pressure-increasing piston 503' are moved apart from each other as the pressure increase control valve 7 is changed from the open valve state to the closed valve state, fuel is returned from the injector 101 to the return passage 11 via the hollow hole formed in the second pressure-increasing piston 503'. Therefore, the fuel pressure in the injector 101 can be quickly reduced, so that the injection pressure of the injector 101 can be quickly reduced.

Figure 12:
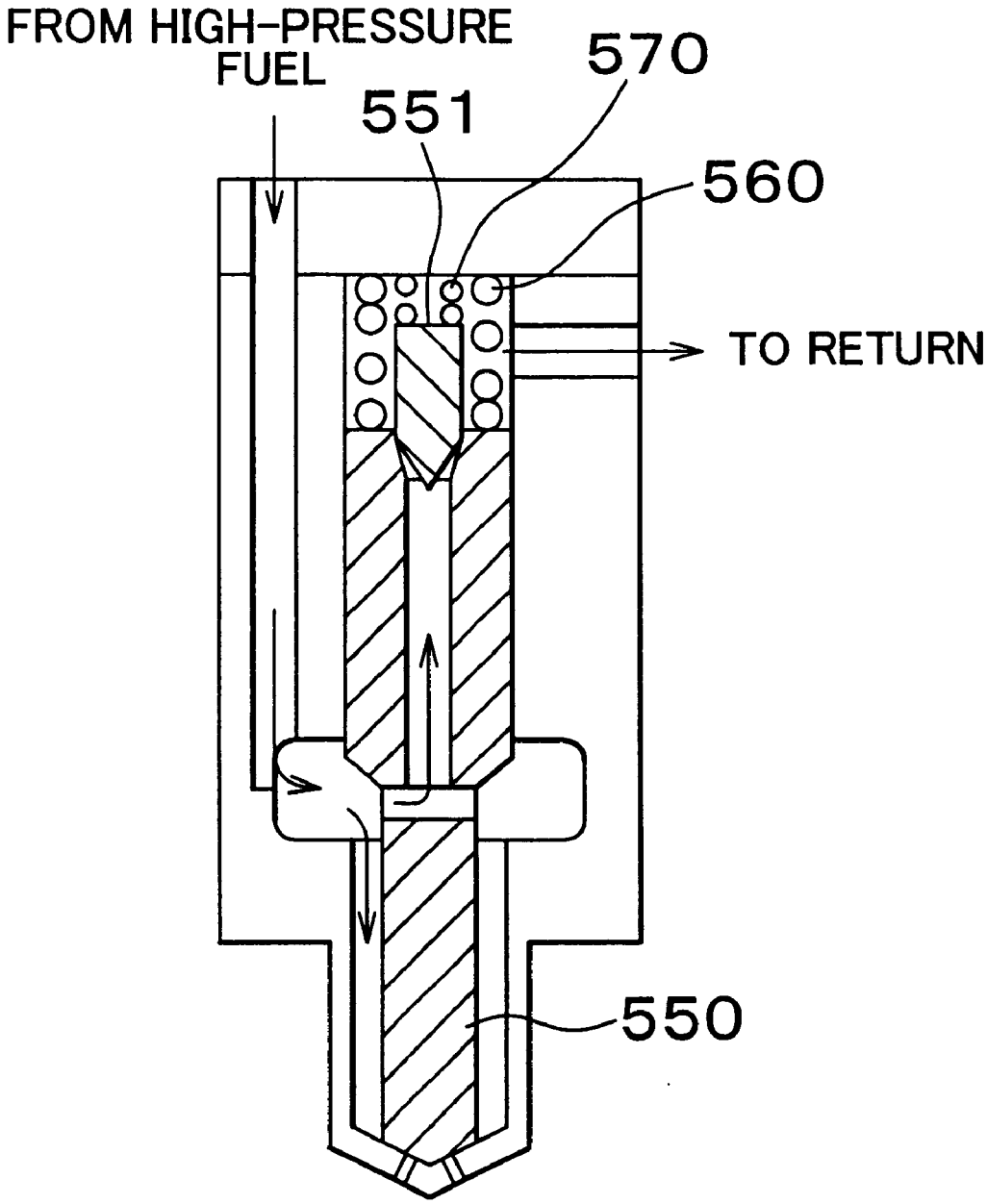
FIG. 12 is a diagram schematically illustrating an injector according to a modification of the fifth embodiment.

A modification of the fifth embodiment of the common rail fuel injection apparatus of the invention will be described below. FIG. 12 is a diagram schematically illustrating an injector according to the modification of the fifth embodiment. Except for the construction of the injector shown in FIG. 12, the construction of the fifth embodiment is substantially the same as the construction of the fifth embodiment shown in FIG. 1. In FIG. 12, reference numeral 550 represents a needle valve, and reference numeral 551 represents a relief valve. A spring 560 is provided for urging the needle valve 550 downwards. A spring 570 is provided for the relief valve 551 downwards. When the pressure increase control valve 7 and the fuel supply control valve 15 are closed, the pressure of fuel supplied to the injector decreases, and the needle valve 550 and the relief valve 551 start to move downwards, as indicated in FIG. 12. The spring forces of the springs 560, 570 are set to such suitable values that the needle valve 550 and the relief valve 551 separate from each other. Therefore, the fuel pressure in the injector can be quickly reduced similarly to the fifth embodiment.

Figure 13:
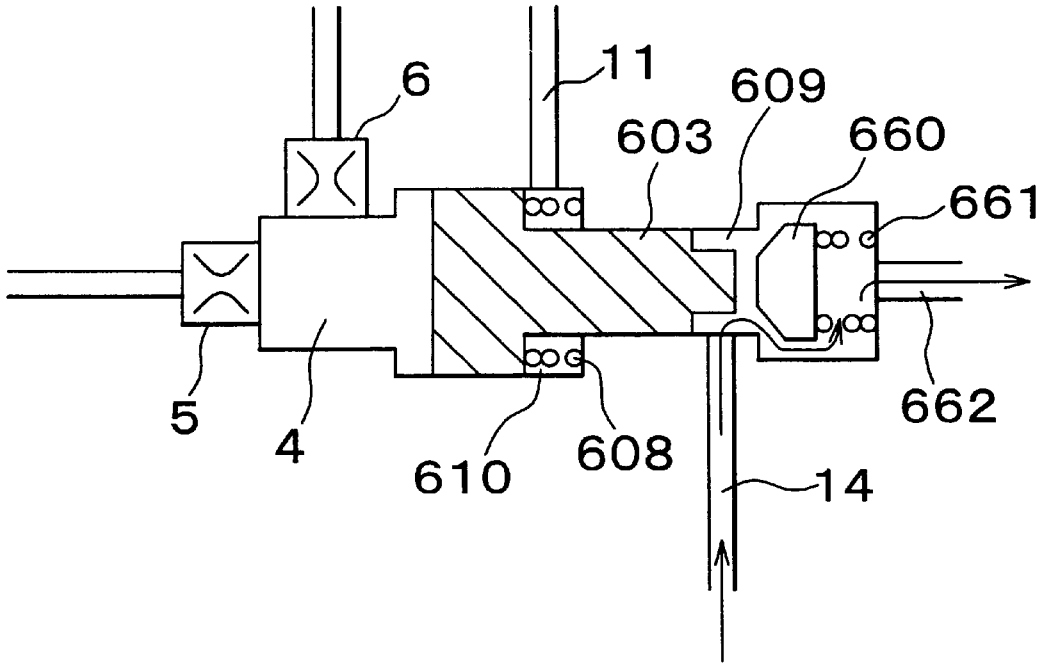
FIG. 13 is a diagram schematically illustrating the construction of a portion of a sixth embodiment.

A sixth embodiment of the common rail fuel injection apparatus of the invention will be described below. The construction of the sixth embodiment is substantially the same as that of the fifth embodiment except for the features and the like described below. Therefore, the sixth embodiment achieves substantially the same advantages as those achieved by the fifth embodiment. FIG. 13 is a diagram schematically illustrating the construction of portions of the sixth embodiment. In FIG. 13, the same reference numerals as those used in FIGS. 1 to 12 represent the same component parts or portions as those shown in FIGS. 1 to 12. In FIG. 13, reference numeral 603 represents a pressure-increasing piston for further increasing the pressure of fuel accumulated in a common rail 2. A spring 608 is provided for urging the pressure-increasing piston 603 in such a direction as to reduce the injection pressure. A high-pressure chamber 609 is designed so that the pressure therein is increased by the pressure-increasing piston 603. A low-pressure chamber 610 is also provided.

A relief valve 660 is provided for relieving fuel from the high-pressure chamber 609 and fuel passages 14, 18. A spring 661 is provided for urging the relief valve 660 in such a direction as to close the relief valve 660. Reference numeral 662 represents a relief passage. The relief valve 660 is opened when the lift of the pressure-increasing piston 603 increases so that the pressure-increasing piston 603 pushes the relief valve 660.

According to the sixth embodiment, the relief valve 660 is provided for blocking a pressure-reducing passage that extends between the injector 101 and the relief passage 662. When the lift of the pressure-increasing piston 603 becomes equal to or greater than a predetermined amount, the relief valve 660 is opened by the pressure-increasing piston 603 so as to connect the injector 101 and the relief passage 662 in communication. Therefore, the fuel pressure in the injector 101 can be quickly reduced, so that the injection pressure of the injector 101 can be quickly reduced.

Figure 14:
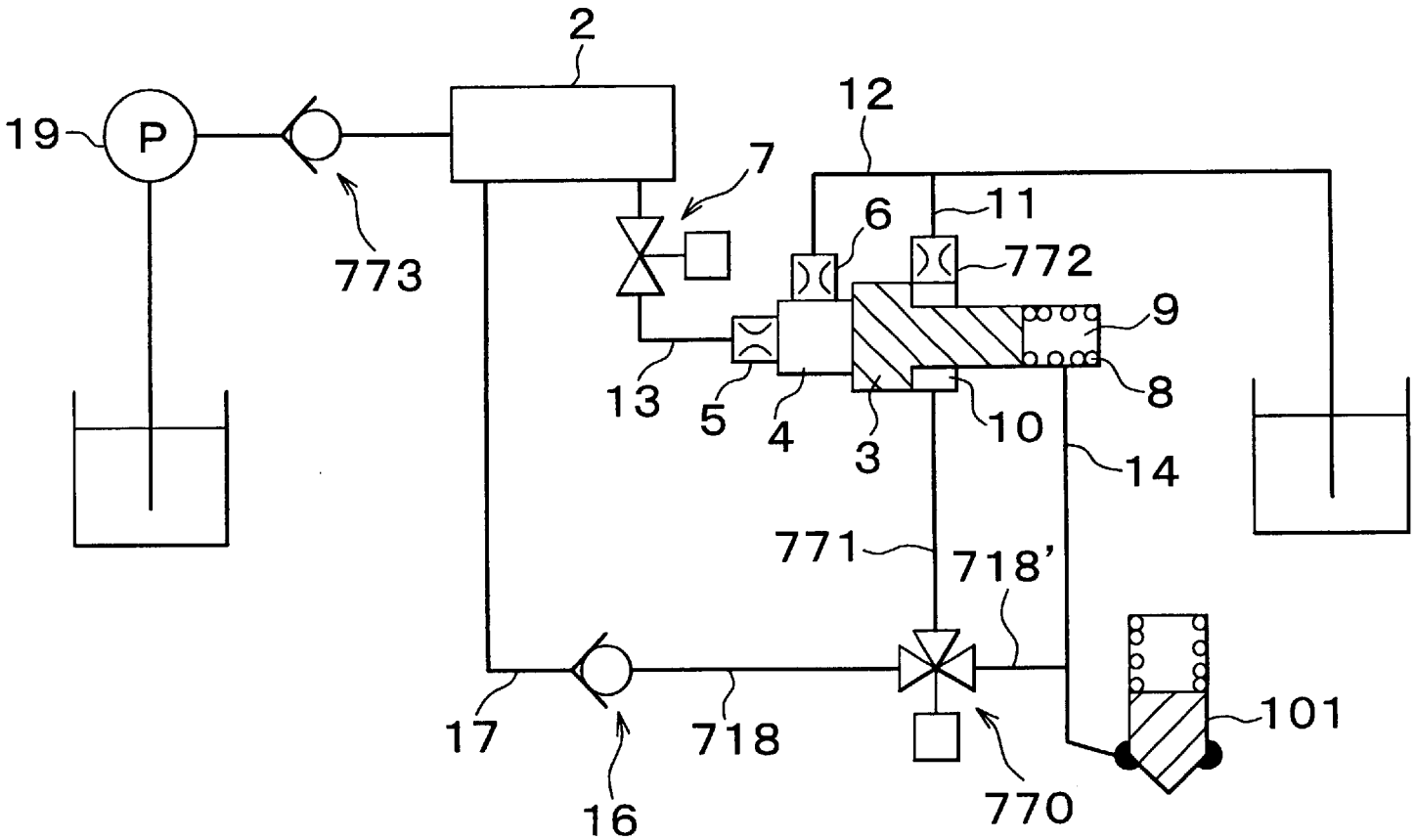
FIG. 14 is a diagram schematically illustrating the construction of a seventh embodiment.

A seventh embodiment of the common rail fuel injection apparatus of the invention will be described below. FIG. 14 is a diagram schematically illustrating the construction of the seventh embodiment. In FIG. 14, the same reference numerals as those used in FIGS. 1 and 4 represent the same component parts or portions as those shown in FIGS. 1 and 4. Thus, the seventh embodiment achieves substantially the same advantages as those achieved by the fifth embodiment. In FIG. 14, reference numeral 770 represents a three-way valve, and 771 represents a fuel passage connecting the three-way valve 770 and a low-pressure chamber 10, and 772 represents an output constricted portion for setting an amount of flow of fuel that exits from the low-pressure chamber 10. Furthermore, reference numeral 773 represents a check valve, and 718, 718' represent fuel passages designed so that the pressure therein increases when the lift of a pressure-increasing piston 3 increases.

The three-way valve 770 is changed in mode by an electric signal. During a first mode during which the pressure of fuel in the high-pressure chamber 9 and the fuel passages 14, 718' should not be reduced, the fuel passage 718 and the fuel passage 718' are connected in communication, and the fuel passage 771 is blocked. During a second mode during which the pressure of fuel in the high-pressure chamber 9 and the fuel passages 14, 718' should be reduced, the fuel passage 718' and the fuel passage 771 are connected in communication, and the fuel passage 718 is blocked. When the three-way valve 770 is changed from the first mode to the second mode, fuel is returned from the high-pressure chamber 9 and the fuel passages 14, 718' via the return passage 11, and the pressure-increasing piston 3 is moved leftwards due to the pressure of fuel in the low-pressure chamber 10. Therefore, the pressure of fuel in the high-pressure chamber 9 and the fuel passages 14, 718' is quickly reduced.

According to the seventh embodiment, when the fuel injection needs to be stopped, the three-way valve 770 disposed in the fuel passage 718, 718' is changed from the first mode to the second mode so as to connect the injector 101 and the return passage 11 in communication. Therefore, the pressure of fuel in the injector 101 can be quickly reduced, so that the injection pressure of the injector 101 can be quickly reduced.

While the invention has been described with reference to preferred embodiments thereof, it is to be understood that the invention is not limited to the preferred embodiments or constructions. To the contrary, the invention is intended to cover various modifications and equivalent arrangements. In addition, while the various elements of the preferred embodiments are shown in various combinations and configurations, which are exemplary, other combinations and configurations, including more, less or only a single element, are also within the spirit and scope of the invention.

What is claimed is:

1. A common rail fuel injection apparatus capable of changing an injection pressure of a fuel injected from an injector, comprising:

a piston that increases the injection pressure of the injector by elevating the injection pressure at the injector outlet and directly pumps the fuel into the injector;

a chamber that controls a position of the piston so as to control the injection pressure;

an input constriction that sets an amount of flow of the fuel that enters the chamber;

an output constriction that sets an amount of flow of the fuel that exits from the chamber; and a valve that controls a passage of the fuel from a common rail to the input constriction.

2. The common rail fuel injection apparatus according to claim 1, wherein the input constriction and the output constriction are set so that the injection pressure is quickly reduced when the valve is closed.

3. The common rail fuel injection apparatus according to claim 1, wherein a closed sub-chamber encloses the fuel disposed between the piston and a stopper provided for the piston, and the closed sub-chamber is in a closed state when an amount of lift of the piston reaches at least a predetermined amount.

4. The common rail fuel injection apparatus according to claim 3, wherein when the amount of lift of the piston reaches at least the predetermined amount, the piston blocks a return passage by which the fuel exits from the closed sub-chamber.

5. The common rail fuel injection apparatus according to claim 1, wherein the injection pressure of the fuel injected from a first injector is increased when the piston moves toward one side, and wherein the injection pressure of the fuel injected from a second injector is increased when the piston moves toward another side.

6. The common rail fuel injection apparatus according to claim 5, wherein a first sub-chamber that pressurizes the fuel in the first injector and a second sub-chamber that pressurizes the fuel in the second injector are linearly disposed in directions opposite to each other.

7. The common rail fuel injection apparatus according to claim 1, wherein the piston is divided into a first piston and a second piston, and the first piston and the second piston are disposed so that a gap is formed between the first piston and the second piston during a closed valve duration of the valve.

8. The common rail fuel injection apparatus according to claim 1, further comprising a relief mechanism that reduces a pressure of the fuel in the injector when the valve is changed from an open state to a closed state.

9. The common rail fuel injection apparatus according to claim 8, wherein a pressure reducing passage extends between the injector and a return passage and is connected in communication when the valve is changed from the open state to the closed state.

10. The common rail fuel injection apparatus according to claim 9, wherein the piston is divided into a first piston and a hollow second piston, and wherein the fuel is returned from the injector to the return passage via a hollow hole in the hollow second piston when the first piston and the hollow second piston are moved apart from each other as the valve is changed from the open state to the closed state.

11. The common rail fuel injection apparatus according to claim 9, wherein a relief valve is provided in the injector, and wherein when the relief valve is moved apart from a needle provided in the injector, the fuel is returned from the injector to the return passage via a hollow hole of the needle.

12. The common rail fuel injection apparatus according to claim 1, further comprising a relief valve for blocking a passage that extends between the injector and a return passage, wherein when an amount of lift of the piston reaches at least a predetermined amount, the piston opens the relief valve so that the injector and the return passage are connected in communication.

13. The common rail fuel injection apparatus according to claim 12, wherein the piston and the relief valve are linearly disposed, and the relief valve is opened by an end of the piston pushing the relief valve overcoming a spring force.

14. The common rail fuel injection apparatus according to claim 1, wherein the injector and the common rail are connected by a fuel supply passage that supplies the fuel to the injector, and wherein a three-way valve is disposed in the fuel supply passage and is connected to the return passage, and wherein when the fuel injection is to be terminated, the three-way valve is switched to connect the injector and the return passage in communication.

15. A method of controlling an injection pressure of a fuel injected from an injector in a common rail fuel injection apparatus, comprising:

increasing the injection pressure of the injector by elevating the injection pressure at the injector outlet and directly pumping the fuel into the injector by a piston;

controlling a position of a piston so as to control the injection pressure;

setting an amount of flow of the fuel that enters a chamber by an input constriction;

setting an amount of flow of the fuel that exits from the chamber by an output constriction; and controlling a passage of the fuel from a common rail.

16. The method of controlling an injection pressure according to claim 15, further comprising:

rapidly reducing the injection pressure when a valve is closed.

17. The method of changing an injection pressure according to claim 15, further comprising:

closing a sub-chamber between the piston and a stopper when an amount of lift of the piston reaches at least a predetermined amount;

blocking a return passage; and preventing the fuel from exiting the sub-chamber.

18. The method of controlling an injection pressure according to claim 15, further comprising:

increasing the injection pressure of a first injector when the piston moves toward one side;

increasing the injection pressure of a second injector when the piston moves toward another side; and linearly disposing the first injector passage and the second injector passage in a direction opposite to each other.

19. The method of controlling an injection pressure according to claim 15, further comprising:

connecting the injector and a return passage when an amount of lift of the piston reaches at least a predetermined amount.

* * * * *

UNITED STATES PATENT AND TRADEMARK OFFICE

CERTIFICATE OF CORRECTION

PATENT NO. : 6,684,855 B2 
DATED : February 3, 2004
INVENTOR(S) : Motoichi Murakami, Yoshimasa Watanabe and Kazuhiro Omae It is certified that error appears in the above-identified patent and that said Letters Patent is hereby corrected as shown below:

Title page,
Item [*] Notice, delete "This patent is subject to a terminal disclaimer"

Signed and Sealed this

Fourteenth Day of December, 2004

JON W. DUDAS
*Director of the United States Patent and Trademark Office*